United States Patent [19]

Weskamp

[11] 4,140,823

[45] Feb. 20, 1979

[54] FOLDABLE CHRISTMAS TREE AND BRANCH HOLDER THEREFOR

[75] Inventor: Robert J. Weskamp, Prospect Heights, Ill.

[73] Assignee: Industrial Park Machine & Tool Co., Inc., Joliet, Ill.

[21] Appl. No.: 783,559

[22] Filed: Apr. 1, 1977

[51] Int. Cl.[2] ..... A47G 33/06

[52] U.S. Cl. ..... 428/9; 428/20

[58] Field of Search ..... 428/8, 9, 18, 19, 20, 428/12; 362/122, 123; D11/118; 211/196, 197, 205; 156/61

[56] References Cited

U.S. PATENT DOCUMENTS

| | | | |
|---|---|---|---|
| 1,683,637 | 9/1928 | Trimpe | 428/8 |
| 2,708,324 | 5/1955 | Wedden | 428/18 X |
| 3,030,720 | 4/1962 | Osswald et al. | 428/8 |
| 3,101,291 | 8/1963 | Lalick | 428/18 X |
| 3,115,435 | 12/1963 | Abramson | 428/20 X |
| 3,574,102 | 4/1971 | Hermanson | 428/20 X |
| 3,616,107 | 10/1971 | Kershner | 428/9 |
| 3,639,196 | 2/1972 | Hermanson | 428/20 X |

*Primary Examiner*—Henry F. Epstein
*Attorney, Agent, or Firm*—Hubbell, Cohen, Stiefel & Gross

[57] ABSTRACT

Artificial Christmas tree comprises a vertically extending trunk member and a plurality of branches having looped rear ends. Tree also includes a plurality of branch holders each including a central tubular member; a plurality of connecting arms integral with said tubular members, each having a pair of spaced apart substantially parallel guides extending outward from the central tubular member, each guide having an aperture therein disposed such that the apertures in each guide pair are registered; and a supporting member extending outward from the central tubular member beneath the guide pair and beyond the apertures. A plurality of securing means extendable through one pair of registered apertures and the looped rear end of a branch disposed therebetween pivotally secure the branches to the connecting arms. Means for mounting the branch holders on the trunk in distributed relation along a portion at least of the length thereof with the central tubular members in surrounding relation with the trunk are also provided.

13 Claims, 8 Drawing Figures

FOLDABLE CHRISTMAS TREE AND BRANCH HOLDER THEREFOR

BACKGROUND OF THE INVENTION

1. Field of the Invention

This invention relates to artificial Christmas trees and in particular to a new and improved branch holder for pivotally securing a plurality of artificial Christmas tree branches to the trunk of an artificial Christmas tree.

2. Prior Art

Artificial Christmas trees are well known. Most artificial Christmas trees comprise a multiplicity of separate branches each formd of a plurality of plastic needles held together by twisting a pair of wires about them. In other instances, the branches are formed by twisting a pair of wires about an elongated sheet of plastic material having a large multiplicity of transverse slits. In still other artificial Christmas trees, the branches are formed by injection molding of plastic.

Irrespective of the form of branch, the most common form of artificial Christmas tree comprises a wooden simulated trunk having a plurality of spaced apart apertures for reception of branches therein to thereby hold the branches in radially extending relation to the trunk to form the artificial Christmas tree. For purposes of storage, the branches are removable requiring the repositioning of the branches on the trunk each time the tree is reassembled. It is well known to reduce the difficulty of this task by color coding the apertures on the trunk with the ends of the branches.

To provide a tree which can be stored without occupying an unduly large amount of space and yet to avoid the need for totally dismantling the tree at the end of each Christmas season and reassembling at the beginning of the next, it has been proposed, as disclosed in a number of patents, to permanently pivotally affix the artificial branches of an artificial Christmas tree to the trunk thereof to permit movement of the branches between an outward lying position in which they are commonly used to a position in which they lie close to the trunk and thereby occupy a comparatively small space to permit storage of the tree. Such a structure was suggested in U.S. Pat. No. 1,683,637 issued to E. H. Trimpe on Sept. 11, 1928 as well as in U.S. Pat. No. 3,030,720 issued to Osswald et al on Apr. 24, 1962. However, both of these patents require elaborate assembly techniques, and in the case of the Osswald et al patent, a somewhat complex structure, thereby rendering both of these prior art patents of little importance in commercial development of artificial Christmas trees.

More recently, U.S. Pat. Nos. 3,574,102 and 3,639,196, both issued to T. Hermanson, as well as pending U.S. application Ser. No. 631,446, now abandoned for Artificial Christmas Tree With Foldable Branches and Method of Making Same, Robert J. Weskamp, et al applicant, have disclosed other artificial Christmas trees with foldable branches. The structures disclosed therein, however, require that the trunk be apertured to permit insertion of either the rear ends of the branches or of a branch connecting member therein. In addition, the structure described in the two Hermanson patents requires some form of bifurcation at the ends of the branches, which bifuracation requires special tooling not heretofore employed in the making of artificial Christmas trees. Moreover, because the branches are adapted for disposition within the apertures which are fixedly distributed along the length of the trunk, the ultimate purchaser of the tree does not have the option of selecting different locations for the branches.

To avoid the necessity of aperturing the trunk, a number of patents have suggested providing a branch holder which may be secured to the trunk of the tree and to which a branch or branches may be secured for pivotal movement between an extended position and a collapsed position. For example, U.S. Pat. No. 2,708,324 issued to M. J. Wedden discloses a branch holder for pivotally securing a single branch to the trunk. However, the branch holder disclosed therein must be fixedly secured to the trunk, such as by welding. As in the case of artificial Christmas trees employing an apertured trunk, such direct welding of the branch holder to the trunk precludes the user of the tree from disposing the branches as he or she wishes. In addition, the additional assembly costs incurred in permanently affixing the branch holders to the trunk reduces the commercialability of the tree disclosed in that patent.

The problems presented by Wedden have been partially overcome by employing branch holders in the form of collars which may be distributed along the length of the trunk and to which a plurality of branches may be pivotally secured. For example, U.S. Pat. No. 3,616,107 issued to Kershner discloses a plastic collar in which pivoting movement of the branches is accommodated by hinged portions which join the branches to the main collar. According to this patent, however, the branches are integrally formed with the collar. Moreover, since the branches are only joined to the main collar through the thin hinge portions, which therefore bear the entire weight of the branch when same is in the collapsed position, possible failure of these collars with prolonged use is possible.

Lastly, Canadian Pat. No. 698,110 issued to A. Abramson as well as U.S. patent application Ser. No. 345,124, now abandoned, for An Artificial Christmas Tree Branch Holder, Method of Forming an Artifical Christmas Tree Therefrom and Resulting Artificial Christmas Tree, C. L. Chou, applicant, (Canadian patent application Ser. No. 233,975 based upon said abandoned U.S. application is currently pending) both disclose still additional collars which may be removably secured to the trunk of an artificial Christmas tree and to which a plurality of branches may be pivotally secured. However, both of these structural embodiments require special structures at the rear ends of the branches, such special structures requiring additional tooling and expense thereby reducing the commercialability of these structures.

SUMMARY OF THE INVENTION

In accordance with the present invention I have developed an artificial Christmas tree which employs a novel branch holder for pivotally securing the branches to the trunk for pivotal movement between a position in which the branches extend outward from the trunk and a position in which the branches are substantially coaxially aligned with the trunk.

The preferred artificial Christmas tree comprises a vertically extending trunk member including upper and lower portions. A stand is secured to the lowermost portion of the lower trunk portion to maintain the vertical orientation of the trunk member during use. The tree further includes a plurality of branches having looped rear ends. The branches are pivotally secured to the trunk member by a plurality of branch holders, each of which includes a central tubular member; a plurality of connecting arms each having a pair of spaced apart substantially parallel guides extending outward from the central tubular member, each of the guides having an aperture therein disposed such that the apertures in each guide pair are registered; and a supporting member extending outward from the central tubular member beneath each guide pair. The branch holders further include a plurality of securing means, preferably comprising injection molded plastic rivets, each being extendable through one pair of registered apertures and the looped rear end of a branch disposed therebetween for pivotally securing the branches to the branch holders. Means are also provided for mounting the branch holders on the trunk in distributed relation along at least a portion of the length thereof with the central tubular members in surrounding relation with the trunk. Preferably, the branch holders are only distributed along the lower trunk portion and another plurality of branches is secured to the upper trunk portion in non-pivotal relation therewith.

By employing the above-described branch holders to pivotally secure the branches to the trunk member, the branches are movable between a position in which the unlooped branch portions adjacent the looped rear ends thereof engage and are supported by the supporting members to hold the branches in an extended position thereby conveying the appearance of a tree, and a position in which the branches are substantially coaxial with the trunk member whereby the components of the tree may be stored in a relatively small space.

Due to the particular integral stamped and bent construction of the novel branch holder described above, the artificial Christmas tree in accordance with the present invention is relatively inexpensive to manufacutre and easily assembled and disassembled for use and storage, respectively. The tree is further advantageous in that it employs conventional artificial Christmas tree branches.

These and other features and advantages will become more fully apparent from the following detailed description and annexed drawings of the preferred embodiments of an artificial Christmas tree in accordance with the present invention.

DETAILED DESCRIPTION OF THE PREFERRED EMBODIMENTS

Figure 1:
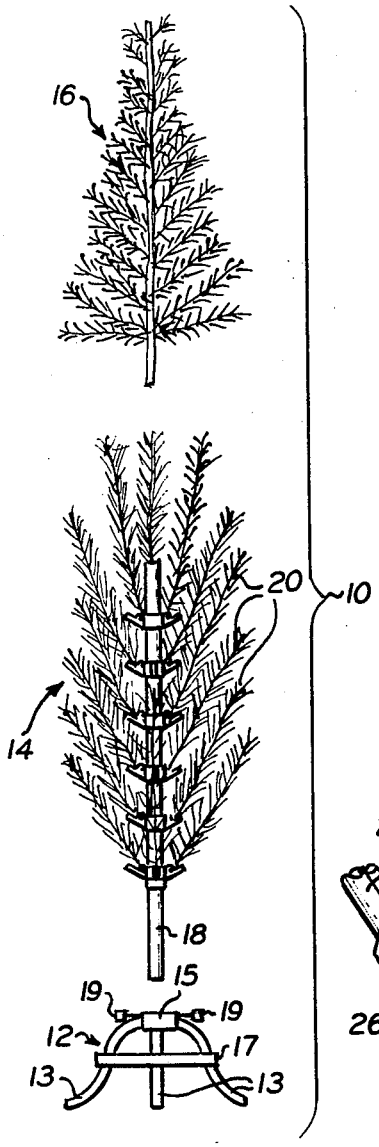
FIG. 1 is a partially exploded view in side elevation of a Christmas tree in accordance with the present invention showing the branches in the storage position.
Figure 2:
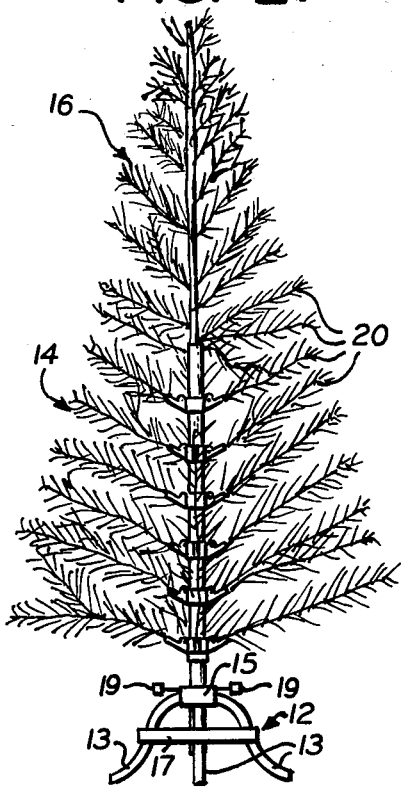
FIG. 2 is a view in side elevation showing the preferred artificial Christmas tree in accordance with the present invention in assembled relation.

Referring now to the drawings in detail, an artificial Christmas tree embodying the present invention is generally designated by the reference numeral 10. Tree 10 comprises a stand 12, a base 14 and a top 16. The stand 12 may be of any suitable construction and forms no part of the present invention. Stand 12 should, of course, be relatively rugged and stable and easily connected to base 14. The stand 12 shown herein by way of example in FIGS. 1 and 2 is a tripod stucture having three legs 13 joined by a connecting ring 15 and a retaining disc 17. Connecting ring 15 has a central opening (not shown) for receiving trunk 18 of the base 14. Trunk 18 from which a plurality of branches 20 extend, may be firmly secured to stand 12 by means of adjustable screws 19.

Figure 3:
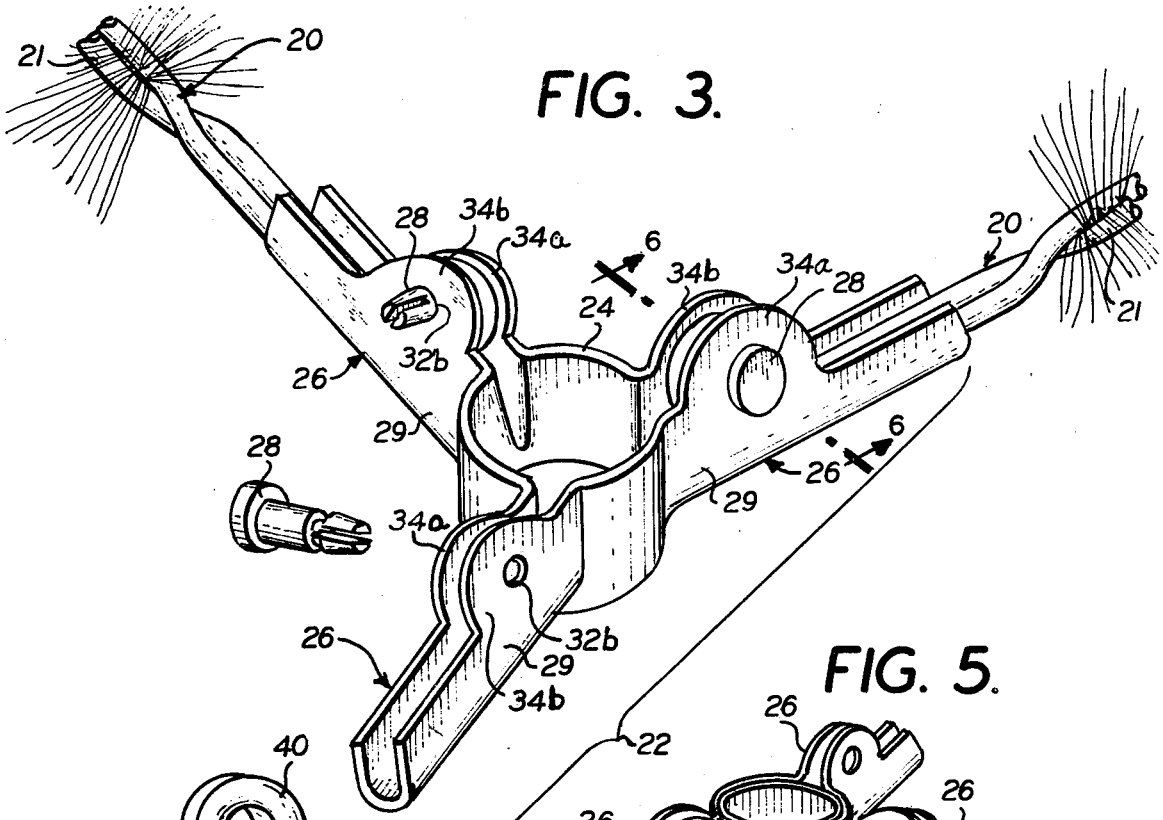
FIG. 3 is a partially exploded perspective view of a branch holder in accordance with the present invention.

With particular reference now to FIG. 3, in accordance with the present invention a branch holder 22 of novel design and construction is employed for mounting the branches 20 on the trunk 18 to permit movement of the branches between an outwardly extending position in which the branches 20 extend away from the trunk 18 in the manner of a natural Christmas tree (FIG. 2) and a position in which the branches 20 are substantially coaxially aligned with the trunk 18 of base 14 to permit easy storage thereof when tree 10 is not in use (FIG. 1). As presently preferred and shown, branch holder 22 is an integral structure including a central tubular member 24, a plurality, here shown as three in number, of branch connecting arms 26 and a plurality of securing elements shown as rivets 28, one for each branch connecting arm. Preferably, branch holder 22 comprises a unitary piece of metal and can be constructed by initially stamping the member from a flat piece of sheet metal and thereafter bending it into the desired shape whereupon the free ends of the central member 24 can be welded together. All of this could, of course, be automated by metal working equipment well known to those skilled in the art.

As presently preferred and shown, each of the branch connecting arms 26, one form of which is illustrated in FIGS. 3–6, is preferably generally U-shaped. The end 29 of each branch connecting arm 26, which end is secured to central tubular member 24 and will hereinafter be referred to as the rear end of the branch connecting arm 26, is provided with a pair of ears **34*a,b* which ears will be located closely adjacent the surface of the trunk 18 when the central tubular member 24 of the branch holder is secured in surrounding relation about said trunk. This will be more fully explained hereinafter. As shown, the ears 34 associated with each arm 26 are provided with through holes 32 which holes are in register with one another. Preferably, one hole 32*a* of each hole pair is slightly larger than the other hole 32*b* of that pair. The reason for this will become more fully apparent hereinafter. As presently preferred and shown, the remainder of each connecting arm 26 is of lesser vertical extent than the ears 34**, but is nevertheless preferably U-shaped.

Figure 5:
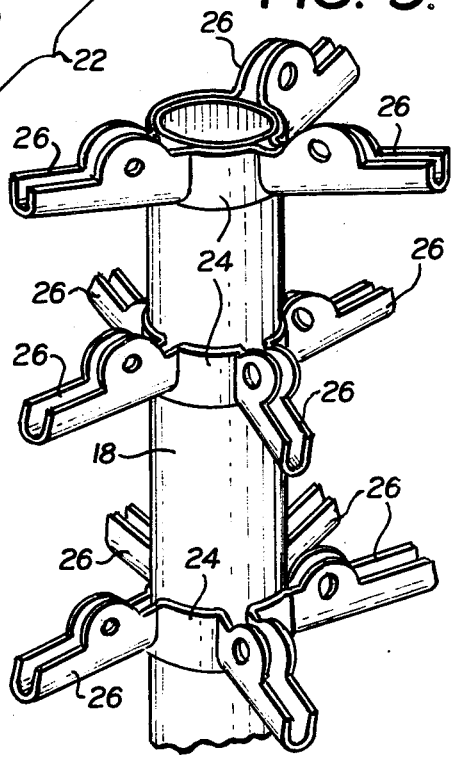
FIG. 5 is a perspective view showing a portion of the trunk member with three branch holders distributed therealong.
Figure 5:
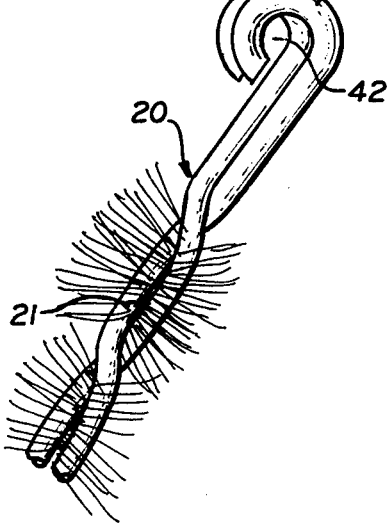

To form the base 14 of the tree 10, central tubular members 24 of branch holders 22 are slipped over one end or the other of the trunk 18. Of course, for this purpose the internal diameter of the central tubular members 24 must be slightly greater than the external diameter of the trunk 18. Preferably, the branch holders 22 will not all have the same number of branch connecting arms 26. Thus, for example, some may have only three arms, others six arms, etc. (FIG. 5). This permits the user of the tree 10 greater versatility in predetermining the appearance of the tree. In addition, the branch holders 22 may be rotated about the trunk 18 thereby permitting the user to predetermine both the longitudinal and circumferential distribution of the branches 20 about the trunk 18.

Figure 4:
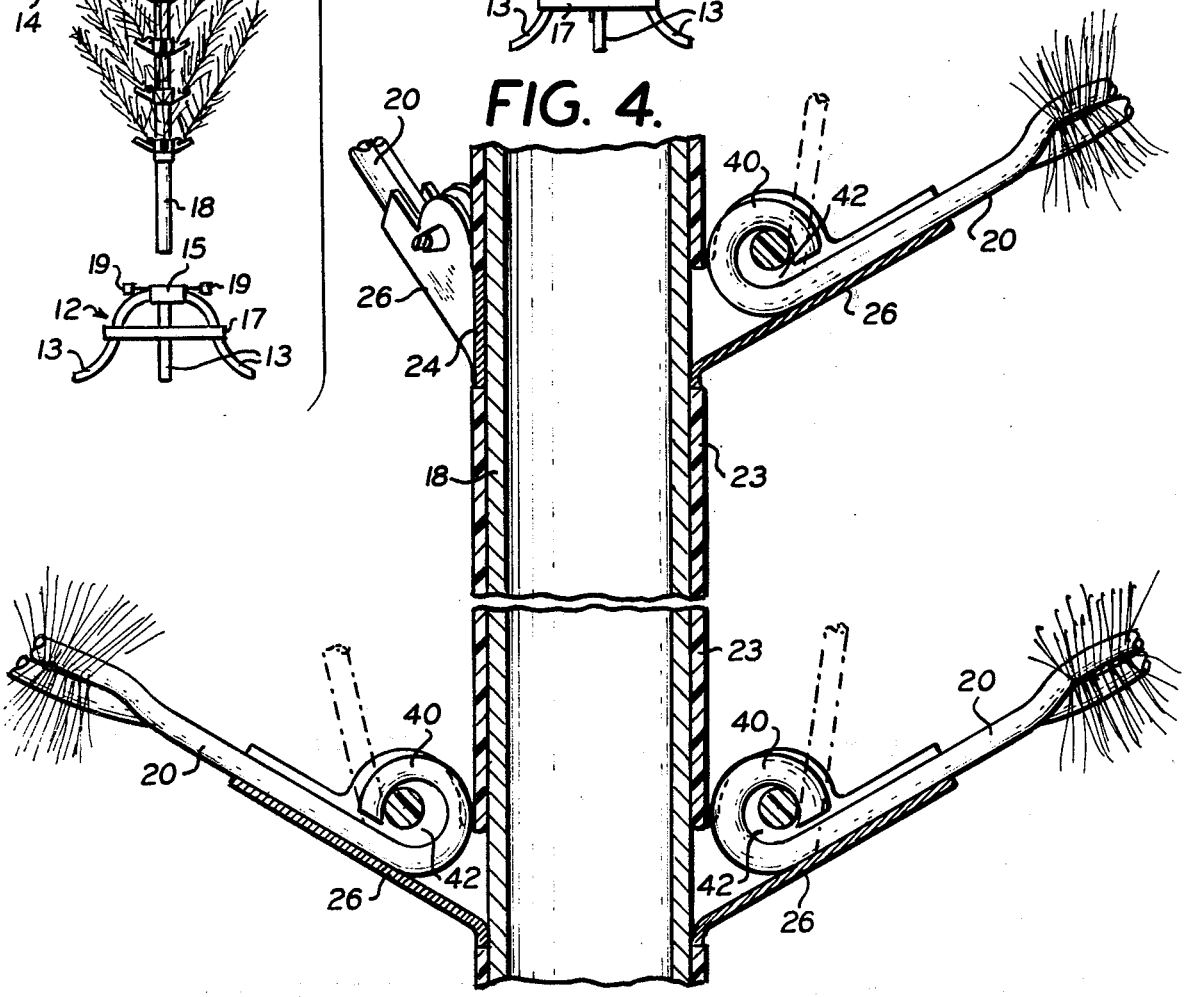
FIG. 4 is a broken fragmentary view in vertical section showing the branches in the extended position (solid lines) and the storage position (dotted lines)

The branch holders 22 may be secured to trunk 18 in a variety of different ways. Preferably, the branch holders 22 will be distributed along the entire length of the trunk 18 such that the lower annular surface of the central tubular member 24 of one branch holder 22 will rest on the upper annular surface of the central member of the next branch holder. If desired, sleeves 23 made of, for example, plastic or metal construction, may be disposed between adjacent branch holders 22 (FIG. 4). By making the plastic sleeves of different lengths, any desired longitudinal distribution of branch holders 22 along trunk 18 could be effected. Alternatively, central members 24 of branch holders 22 could be fixedly secured to trunk 18 prior to shipping, such as, for example, by being welded or riveted thereto. Of course, if this latter alternative is employed the staggering of the branches 20 about base member 14 will not be alterable by the user of tree 10. As a further alternative, the diameters of the central tubular members 24 and trunk 18 may be dimensioned to permit force fitting of the central tubular member 24 about the trunk 18.

Referring now to FIGS. 3 and 4, the rear looped end of a branch 20 is shown. Branch 20 may be of any suitable type of artificial branch. Preferably, however, the branch 20 has a central limb member 21 in the form of a pair of twisted wires from which extend a multiplicity of artificial needles which are permanently held between the wire pair of the limb member as by twisting. Such a branch may be made in accordance with U.S. Pat. No. 2,742,327, the contents of which are hereby incorporated by reference herein in their entirety. If desired, the branches 20 may be furcated at their outer ends to form twigs. Regardless of the method of construction of the branches 20, the rear most portion of each branch 20 is bent to form a loop 40 that defines a central aperture 42. The loop 40 is disposable between the ears 34 of a connecting arm 26 with the central aperture 42 of the loop 40 in register with the apertures 32 of the ears 34. When so registered, a suitable securing element such as, for example, the rivet 28 illustrated in the drawings, may be inserted through the registered apertures 32, 42 and secured to the connecting arm 26 to act as a pivot for the branch 20.

Figure 6:
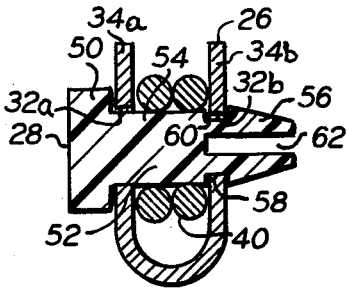
FIG. 6 is a view in vertical section taken substantially along the lines 6—6 in FIG. 3.

With particular reference to FIGS. 3 and 6, the rivet 28 has a head 50 and a shank 52. The shank is divided into two portions, a head end portion 54 adjacent the head 50 and a tail end portion 56 which is tapered. As noted above, the aperture 32*a* in the ear 34*a* adjacent the head 50 is of a diameter larger than the diameter of the head end portion 54 of the shank 52 whereby to permit passage of the shank therethrough. The aperture 32*b* in the ear 34*b* remote from the head 50 is of somewhat small diameter than the head end portion 54 of the shank so as to prevent its passage therethrough. Provided in the shank 52 in the zone of meeting of the head end portion and the tail end portion thereof is a circumferential groove 58 which is preferably somewhat smaller in diameter than aperture 32*a*. However, the edge of the groove defined by the tail end portion, that is the edge 60, is of larger diameter than the aperture 32*b*. To mount a branch 20 on a connecting arm 26, the looped end 40 thereof is positioned so that the central aperture 42 registers with the apertures 32*a,b*. The shank 52 of rivet 28 is then aligned with the registered apertures on the side of the connecting arm 26 adjacent the ear 34*a*. The rivet 28 is then inserted through the aperture 32*a* and aperture 42 and then to the aperture 32*b* where it will bear against the surface defining said aperture because it is of greater diameter than said aperture. At this point, longitudinal thrust applied to the head 50 of rivet 28 will force the tail end 56 to move against the wall of aperture 32*b* which will deflect or compress the tail end, which compression is permitted by a slot 62. Further longitudinal movement will continue until the groove 58 straddles the ear 34*b* at which point the tail end will snap out to thereby seat the ear 34*b* in the groove 58 of the shank 52 to hold the rivet 28 in place.

Clearly, at least the tail end portion of the rivet 28 must be elastically deformable. Preferably, the entire rivet is a unitary member made of elastically deformable material such as, for example, steel or a wide number of plastics, for example polystyrene, polypropylene or any of the myriad of other well known materials. Most preferably, the elastically deformable plastic material should be injection moldable whereby to permit the injection molding of the rivet.

Having thus secured the branch 20 to the connecting arms 26, the branch is clearly movable between an essentially horizontal position (solid lines FIG. 4) in which the branch 20 extends outwardly from the trunk 18 and a substantially vertical position (dotted lines FIG. 4) in which the branch 20 is substantially coaxially aligned with trunk 18.

As presently preferred and shown, although not necessarily, the space defined between the upstanding leg portions of U-shaped member 26 communicates with the cylindrical space defined by central tubular member 24. In addition, apertures 32 are preferably so spaced from the outer surface of the member 24 that when the branches 20 are disposed in the connecting arms 26 and secured therein by rivets 28, the looped ends 40 thereof will rest against the trunk 18 of base 14 thereby lending further support to the branches 20.

To assemble the tree 10, the branch holders 22 may first be fitted about the trunk 18 using, for example, any of the methods more fully described above. Then the branches 20 may be secured to the connecting arms 26. Alternatively, the branches 20 may first be secured to the connecting arms 26 of the branch holders 22 and the assembled branch holders then fitted about trunk 18. It will be apparent that whatever method is employed, branches 20 need not be disposed in every connecting arm 26. This permits still further variation of the appearance of tree 10.

Preferably, the branches 20 of maximum length are inserted into connecting arms 26 of the branch holders 24 associated with the lowermost portion of the base 14 of tree 10. Branches of progressively shorter lengths will then be disposed in the connecting arms of the remaining branch holders secured about trunk 18. Thus when the tree is finally constructed, it will take a substantially conical configuration thereby giving it a more realistic appearance. Clearly, however, no particular order of mounting the branches is required for practicing the present invention. Preferably, before branches 20 are secured to trunk 18, the lower portion of the trunk will preferably be first secured to stand 12 thereby facilitating assembly of the base 14.

Preferably, although not necessarily, section 16 of tree 10 is not formed in accordance with the method described hereinabove with respect to the base 14 since the length of the branches associated with the section 16 are sufficiently small that they occupy little space even in the extended position. Thus, in forming a tree in accordance with the present invention, the top section 16 may be permanently formed in accordance with any of a variety of prior art techniques. Desirably, the bottom of the top section 16 of the tree 10 is wedge-shaped so that it may be nested within a complimentary aperture (not shown) in the top of trunk 18 to thereby releasably secure top section 16 to base 14. When section 16 is so nested in the top of base 14 the tree 10 is complete and takes the appearance illustrated in FIG. 2.

When the tree is disassembled and the branches 20 on base 14 are folded so that their limb members are substantially aligned with trunk 18, (FIG. 1) the tree sections 14, 16 may be stored in a relatively small sized container considering the final volume of the erected tree. The stand 12 of tree 10, which also may be foldable, will also occupy little space.

The branches 20 to be disposed in the connecting arms 26 of branch holders 24 have been described as having limb members comprised of a pair of twisted wires. This is not absolutely necessary and the branch 20 may be of any type as long as the rear end thereof is bent to form a loop defining a central aperture. However, the twisted wire pair construction is preferred, since this reduces the complexity of structure and number of steps necessary to provide and assemble a tree 10 in accordance with the present invention.

Figure 7:
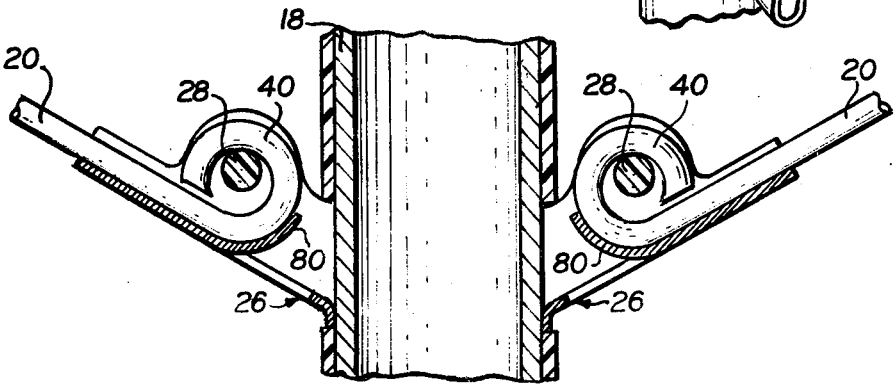
FIG. 7 is a fragmentary view in vertical section illustrating a modification to the branch holder of the present invention and also illustrating plastic sleeves which may be employed to mount the branch holders on the trunk in distributed relation along the length thereof.

In one modification illustrated in FIG. 7, the bite of each U-shaped connecting arm 26 adjacent the rear most portion thereof is provided with an upstruck member 80 which portion serves as an arcuate bearing surface for the looped end 40 of the branch 20. In this embodiment the apertures 32 are so spaced from central tubular member 24 that the looped rear ends 40 of branches 20 do not contact trunk 18 of base 14.

Figure 8:
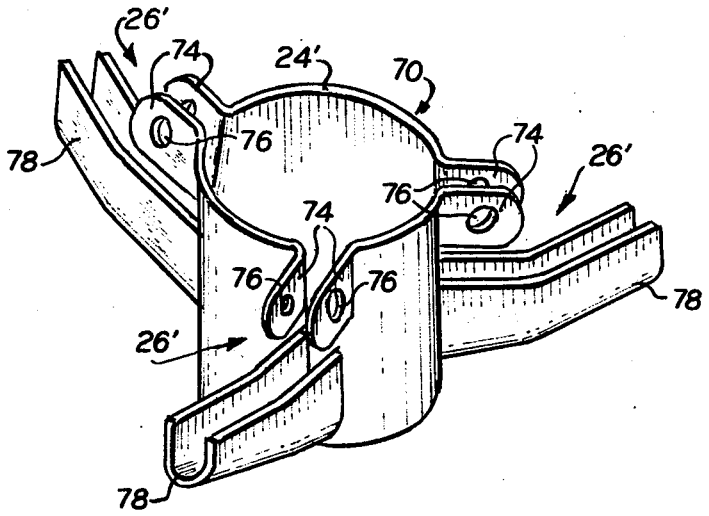
FIG. 8 is a perspective view of an alternative embodiment of a branch holder in accordance with the present invention.

Referring now to FIG. 8 a further embodiment of a branch holder 70 in accordance with the present invention is illustrated. In FIG. 8, however, the connecting arms 26' are of a different configuration than the arms 26 of FIGS. 1–7. Thus the connecting arm 26' comprises a plurality of pairs of spaced apart substantially parallel members 74 which extend outwardly from the central tubular member 24'. As shown, each of the members 74 has an aperture 76 therein which apertures serve the same function as the apertures 32 of FIGS. 1–7. Each arm 26' also includes a supporting member 78, which extends outwardly from the tubular member 24' beneath the members 74 and beyond the apertures 76. Supporting members 78 serve the same purpose as the bite of the U-shaped connecting arms 26 of FIGS. 1–7. Thus they support the branches 20 when the branches are in the extended position. In use, the loop 40 at the rear end of a branch 20 is disposed between a pair of members 74 with the aperture 42 registered with the apertures 76. The rivet 28 or other securing element is then passed through the registered apertures for pivotally securing the branch to the branch holder as is more fully described above.

It is necessary that the supporting member 78 extend beyond the apertures 76 in order to provide adequate support for the branch 20 when the branch is in the extended position. Moreover, it will be apparent that while the length of the members 74 is not critical, they should be of sufficient length to inhibit lateral motion of the branch 20.

Since these and other modifications and changes are within the scope of the present invention the above description should be construed as illustrative and not in the limiting sense.

What is claimed is:

1. An artificial Christmas tree comprising:
(a) a vertically extending trunk member;
(b) a plurality of branches having looped rear ends;
(c) a plurality of branch holders, each of said branch holders comprising:
(i) a central tubular member;
(ii) a plurality of connecting arms each including a pair of spaced apart substantially parallel guides extending outwardly from said central tubular member, each of said guides having an aperture therein, the aperture in one guide of said pair being registered with the aperture in the other guide of said pair and a supporting member extending outwardly and upwardly from said central tubular member beneath said pair of guides and beyond said apertures whereby an acute angle is formed between said supporting member and the axis of said central tubular member; and
(iii) a plurality of securing means each being extendable through one pair of registered apertures and the looped rear end of a branch disposed therebetween for securing said branches to said branch holders for pivotal movement of said branches between an outstanding position in which the unlooped portions of said branches adjacent said rear ends engage said supporting members to be held thereby in said outstanding position and a position in which said branch members are substantially coaxial with said trunk member;
(d) means disposed behind the apertures in each of said connecting arms and extending upwardly relative to said supporting members for providing bearing surfaces for the looped rear ends of said branches when said branches are in said outstanding positions; and
(e) means for mounting said branch holders on said trunk in distributed relation along a portion at least of the length thereof with the central tubular members in surrounding relation with said trunk member.

2. An artificial Christmas tree according to claim 1, wherein said central tubular member and said branch connecting arms are integrally formed of metal.

3. An artificial Christmas tree according to claim 1, wherein said trunk member comprises at least an upper trunk portion detachably connectable to a lower trunk portion, said branch holders only being distributed along said lower trunk portion, and further comprising another plurality of branches fixed to said upper trunk portion in non-pivotal relation therewith.

4. An artificial Christmas tree according to claim 1, wherein said supporting members are generally U-shaped and longer than their associated guide pairs, and wherein said supporting members are at an acute angle to the axis of said trunk member.

5. An artificial Christmas tree according to claim 4, wherein said central tubular member and said branch connecting arms are integrally formed of metal, wherein the lower edges of said guide pairs are joined to the upper longitudinal edge portions of the legs of their associated supporting members, whereby said connecting arms comprise unitary structures, wherein the space defined by said guide pairs and said supporting member legs is in communication with the cylindrical space defined by the central tubular member associated therewith, and wherein said plurality of securing means comprises a plurality of rivets.

6. In a branch holder for pivotally securing a plurality of branch members having looped rear ends to a vertically extending trunk member to permit movement of said branch members between positions outstanding from said trunk and positions substantially coaxial with said trunk, said branch holder being of the type including a central tubular member securable in surrounding relation with said trunk member, the improvement in said branch holder comprises:

a plurality of connecting arms, each of said connecting arms including (a) a pair of spaced-apart substantially parallel guides extending outwardly from said central tubular member, each of said guides having an aperture therein, the aperture in one guide of said pair being registered with the aperture in the other guide of said pair, and (b) a supporting member extending outwardly from said central tubular member beneath said pair of guides and beyond said apertures whereby an acute angle is formed between said supporting member and the axis of said central tubular member;

a plurality of securing means each being extendable through one pair of registered apertures and the looped rear end of a branch disposed therebetween for pivotally securing said branches to said trunk member to permit movement of said branches between said outstanding position in which the unlooped portion of said branches adjacent said rear ends engage said supporting member to be held thereby in said outstanding position, and said position in which said branch members are substantially coaxial with said trunk member; and means disposed behind the apertures in each of said connecting arms and extending upwardly relative to said supporting members for providing bearing surfaces for the looped rear ends of said branches when said branches are in said outstanding positions.

7. A branch holder according to claim 6, wherein said central tubular member and said branch connecting arms are integrally formed of metal.

8. A branch holder according to claim 7 wherein said supporting members are generally U-shaped and longer than their associated guide pairs, wherein the supporting members associated with each central tubular member are at an acute angle to the axis thereof, and wherein said plurality of securing means comprises a plurality of rivets.

9. A branch holder according to claim 7, wherein the space defined by said guide pairs and said supporting member legs is in communication with the cylindrical space defined by the central tubular member associated therewith.

10. A branch holder according to claim 6, wherein said bearing surface providing means comprises upstruck portions provided in the portions of said supporting members adjacent said central tubular members, said upstruck portions being aligned with the space between their associated guide pairs.

11. A branch holder according to claim 9, wherein said bearing surface providing means comprises spacing said apertures relative to said central tubular members such that said trunk member comprises said bearing surface.

12. An artificial Christmas tree according to claim 1, wherein said bearing surface providing means comprises upstruck portions provided in the portions of said supporting members adjacent said central tubular members, said upstruck portions being aligned with the space between their associated guide pairs.

13. An artificial Christmas tree according to claim 5, wherein said bearing surface providing means comprises spacing said apertures relative to said central tubular members such that said trunk member comprises said bearing surface.

* * * * *